United States Patent [19]

Ritzman et al.

[11] Patent Number: 4,695,775

[45] Date of Patent: Sep. 22, 1987

[54] IMAGING SYSTEM HAVING AN IMPROVED ELECTROSTATIC YOKE AND METHOD OF MAKING SAME

[75] Inventors: Ira G. Ritzman, Paradise Township, Lancaster County; Joseph W. Wright, Lancaster, both of Pa.

[73] Assignee: RCA Corporation, Princeton, N.J.

[21] Appl. No.: 863,430

[22] Filed: May 15, 1986

[51] Int. Cl.[4] ..... H01J 29/74; H01J 29/46

[52] U.S. Cl. ..... 315/410; 313/436; 313/450

[58] Field of Search ..... 315/410, 17, 5.24; 313/436, 432, 434, 437, 450, 439

[56] References Cited

U.S. PATENT DOCUMENTS

| | | | |
|---|---|---|---|
| 2,080,449 | 5/1937 | Von Ardenne | 250/27 |
| 2,185,239 | 1/1940 | Von Ardenne | 250/158 |
| 2,293,539 | 8/1942 | Gray | 250/155 |
| 2,302,118 | 11/1942 | Gray | 250/157 |
| 2,312,723 | 3/1943 | Llewellyn | 315/5.24 |
| 3,319,110 | 5/1967 | Schlesinger | 315/17 |
| 3,666,985 | 5/1972 | Schlesinger | 315/31 |
| 3,731,136 | 5/1973 | Roussin | 315/16 |
| 3,796,910 | 3/1974 | Ritz, Jr. | 315/17 |
| 4,547,957 | 10/1985 | Savoye et al. | 29/572 |

OTHER PUBLICATIONS

Internal Electrostatic Deflection Yokes, Electronics, 105 (Jul. 1952) by K. Schlesinger.

*Primary Examiner*—Theodore M. Blum
*Assistant Examiner*—Gregory C. Issing
*Attorney, Agent, or Firm*—Eugene M. Whitacre; Dennis H. Irlbeck; Vincent J. Coughlin, Jr.

[57] ABSTRACT

An imaging system for focusing and deflecting an electron beam comprises, as in prior systems, an evacuated envelope structure having a longitudinal axis and a solenoid for generating a substantially uniform magnetic field within the envelope and along the longitudinal axis thereof. As in prior systems of this type, the envelope includes an electrostatic yoke therein for generating a variable substantially uniform electric field within the envelope to deflect the electron beam along two coordinates of the system. The electric field is orthogonal to the magnetic field. An electron gun within the envelope generates and directs the electron beam through the magnetic and electric field to a target located opposite the electron gun and in a plane perpendicular to the axis of the tube. Unlike prior systems, the electrostatic yoke of the present system comprises a first conductive layer bonded to the interior surface of the envelope, and a second conductive layer overlying the first conductive layer. The first conductive layer has a thickness in the range of about 500 to 1000 Å and the second conductive layer has a thickness in the range of about 800 to 1500 Å. The first and second layers include two pairs of interleaved electrodes. A method of making the electrostatic deflection yoke is also disclosed.

11 Claims, 2 Drawing Figures

IMAGING SYSTEM HAVING AN IMPROVED ELECTROSTATIC YOKE AND METHOD OF MAKING SAME

BACKGROUND OF THE INVENTION

The invetnion relates to an improved electrostatic yoke for an imagining system, and more particularly to a yoke formed of two overlying conductive layers that have low electrical resistance and which adhere well to an interior surface of a glass envelope of a tube used in the imaging system.

U.S. Pat. No. 3,319,110 issued to Schlesinger on May 9, 1967 describes an electron focus projection and scanning (FPS) system which utilzes a mixed field system for focusing and deflecting an electron beam. The FPS system comprises a camera tube and an external coil. The coil provides an axially directed magnetic focus field. The tube contains an internal electrostatic yoke or deflectron formed of pairs of interleaved horizontal and vertical deflection electrodes which are attached or formed on the interior surface of the tube envelope. The electrostatic yoke generates a rotatable, bi-axial uniform electric field orthogonal to the magnetic field generated by the coil. The crossed electric and magnetic fields constitute a "focus projection and scanning" or "FPS" cavity in the central portion of the tube envelope. An FPS system provides high image resolution, high beam current density with minimum power requirements, size and weight. Conventional all-electrostatic imaging systems have an inherently long beam system and all-magnetic imaging systems are bulky, heavy and require a large amount of power. Therefore, in applications where power requirements, size and weight are to be minimized the FPS system is preferred.

U.S. Pat. No. 3,731,136 issued to Roussin on May 1, 1973 describes one configuration of an electrostatic yoke formed by depositing a thin layer of a conductive material on the interior surface of the tube envelope. The suggested methods for depositing the conductive material include spraying, evaporating and electroplating a single layer of metals.

It has been detemined that a suitable electrostatic yoke should have a resistance of about 100 ohms or less measured at the longitudinal extremes of each of the four patterns which comprise the electrostatic yoke. Additionally, the patterns must be capable of withstanding the extreme heat generated by sealing of certain of the electron gun elements into the tube envelope and must withstand abrasion from the electrical contacts of the electron gun. In order to meet these stringent requirements, the conductive layer used to form each of the patterns of the yoke was, in prior structures, frequently of sufficient thickness as to peel or flake-off the envelope. This resulted in conductive particles within the tube and, in extreme cases, in a lack of continuity in the electrostatic yoke.

SUMMARY OF THE INVENTION

An imaging system for focusing and deflecting an electron beam comprises, as in prior systems, an evacuated envelope structure having a longitudinal axis and magnetic field means for generating a substantially uniform magnetic field within the envelope and along the longitudinal axis thereof. As in prior systems of this type, the envelope includes an electrostatic yoke therein for generating a variable substantially uniform electric field within the envelope to deflect the electron beam along two coordinates of the system. The electric field is orthogonal to the magnetic field. An electron gun within the envelope generates and directs the electron beam through the magnetic and electric fields to a target located opposite the electron gun and in a plane perpendicular to said axis of the envelope. Unlike prior systems, the electrostatic yoke of the present system comprises a first conductive layer bonded to the interior surface of the envelope and a second conductive layer overlying the first conductive layer. The first conductive layer has a thickness in the range of about 500 to 1000 Å. and the second conductive layer has a thickness in the range of about 800 to 1500 Å. The first and second layers include two pairs of interleaved electrodes. A method of making the electrostatic deflection yoke is also disclosed.

DETAILED DESCRIPTION OF THE PREFERRED EMBODIMENT

Figure 1:
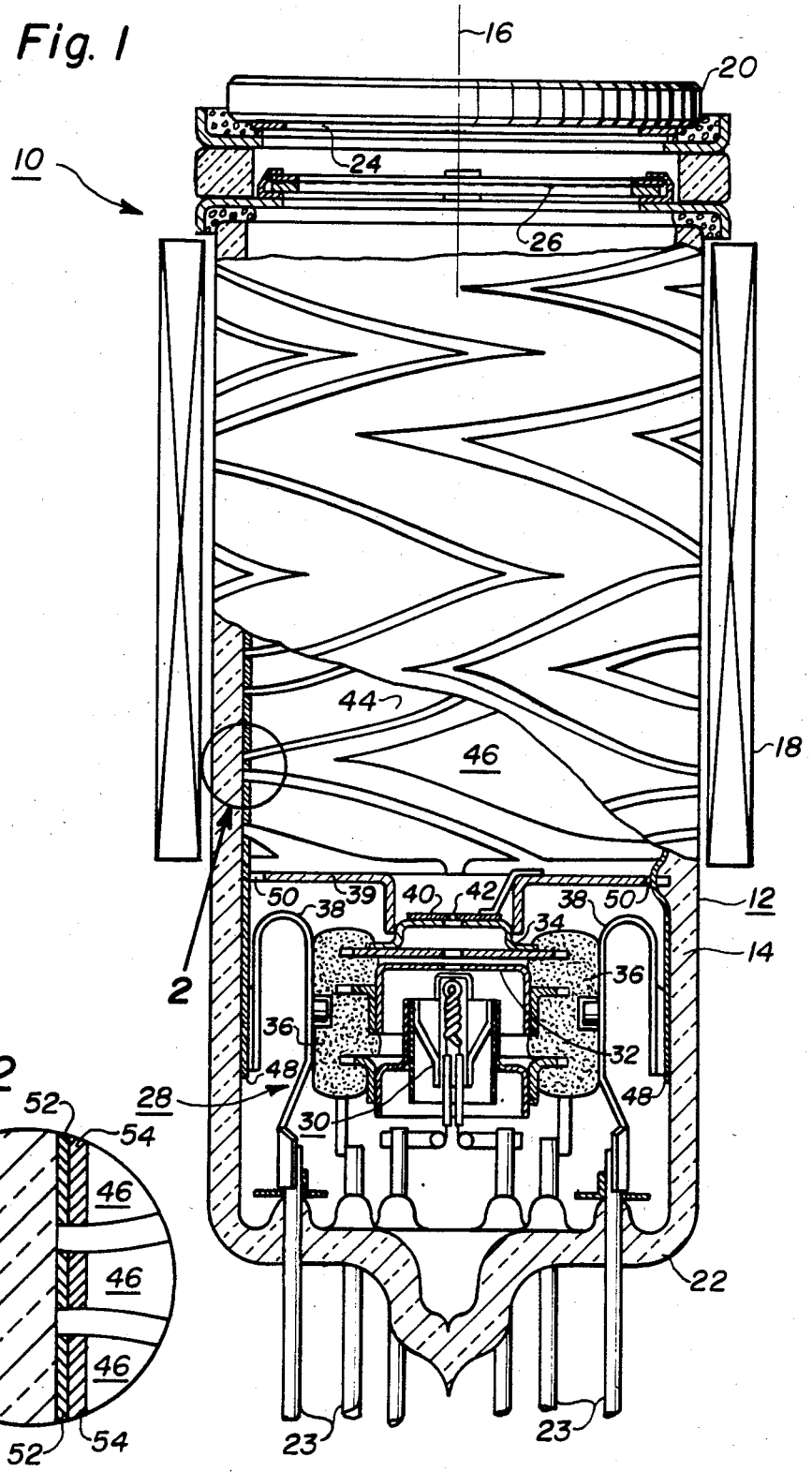
FIG. 1 is an enlarged elevational view, partially in section, of an imaging system according to the present invention.

With reference to FIG. 1, an imaging system 10 comprises an FPS camera tube 12 having an evacuated glass envelope 14 with a longitudinal axis 16. A solenoid 18 is positioned over the exterior surface of the envelope 14, surrounding and axially extending along the central portion of the envelope. The solenoid comprises magnetic field means for generating a substantially uniform magnetic field along the axis 16 and within the envelope 14. A faceplate 20 closes one end of the envelope 14 and a stem assembly 22 closes the oppositely disposed other end of the envelope. The stem assembly 22 includes a plurality of conductive stem leads 23 extending therethrough. A target 24 is disposed adjacent to the faceplate 20 and in a plane perpendicular to the longitudinal axis 16. The target 24 may be formed of silicon, antimony trisulfide or any of the other target materials known in the art. In the preferred embodiment the target 24 comprises a silicon wafer of the type described in U.S. Pat. No. 4,547,957 issued to Savoye et al. on Oct. 22, 1985 and incorporated by reference herein for the purpose of disclosure. A mesh electrode 26 is spaced from the target 24 to decelerate and electron beam (not shown) that is generated and directed from an electron gun 28 disposed within the envelope 14 adjacent to the stem assembly 22.

The electron gun 28 comprises a cathode assembly 30, a control grid (G1) electrode assembly 32 and an anode electrode assembly 34. The aforementioned gun elements are secured in spaced-apart relation to a plurality of support beads 36 which are symmetrically disposed around the electron gun 28. A plurality of electrical connectors 38 longitudinally and radially position the electron gun 28 on and along the longitudinal axis 16. An anode support 39 centers the top end of the anode electrode assembly 34. A beam-limiting plate 40 having a small beam-limiting aperture 42 therethrough is attached to the anode electrode assembly 34 and is centered on the longitudinal axis 16 of the envelope in order to limit the radial extent of the electron beam. The anode support 39 is sealed into the interior surface of the envelope 14. The elements of the electron gun 28 are electrically connected to selected ones of the stem leads 23.

An FPS cavity 44 is longitudinally disposed between the anode support 39 and the mesh electrode 26. The FPS cavity 44 comprises a novel cylindrical electrostatic deflection yoke 46 within the envelope 14 for generating a variable strength substantially uniformly distributed electric field, within the envelope, to deflect the electron beam from the electron gun 28 along two coordinates of the system 10. The electric field is orthogonal to the magnetic field generated by the solenoid 18.

The electrostatic deflection yoke 46 is attached or, preferably, formed on the interior surface of the envelope 14 as described hereinafter. The yoke 46 is coextensive with the solenoid 18 and includes two pairs of electrodes interleaved in a zig-zag pattern which provides simultaneous horizontal and vertical deflection forces on the electron beam. The yoke 46 has four terminals 48, only two of which are shown in FIG. 1, which extend longitudinally along the interior surface of the envelope 14 toward the stem assembly 22. The anode support 39 has four equally spaced notches 50 (only two of which are shown) formed in the periphery thereof and extending into the body of the support which span the terminals 48 and permit the terminals 48 to be electrically contacted by the four electrical connectors 38.

The operation of the deflection yoke 46 is described in the above-mentioned U.S. Pat. No. 3,319,110, which is incorporated by refernece herein for the purpose of disclosure.

Figure 2:
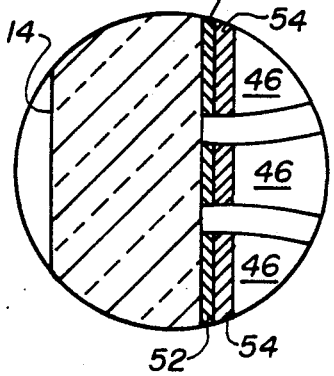
FIG. 2 is an enlarged portion of the imaging system within circle 2 of FIG. 1.

The novel electrostatic deflection yoke 46, a portion of which is shown in FIG. 2, includes a first conductive layer 52, bonded to a portion of the interior surface of the envelope 14, and a second conductive layer 54 overlying the first layer 52. The first conductive layer 52 is preferably formed of nickel having a thickness in the range of about 500 to 1000 Å. While nickel is preferred for its relative hardness and the integrity of the bond it makes to the surface of the envelope 14, copper may also be used. The second conductive layer 54 is preferably formed of gold having a thickness in the range of about 800 to 1500 Å. While the gold is preferred, silver may also be used.

Prior to applying the conductive layers 52 and 54, the exterior and interior surfaces of the glass envelope 14 are carefully cleaned. The surfaces may be cleaned by any of the known scouring or washing methods used to remove dirt, lint, oil, scum, etc. It is preferred to wash the surfaces of the envelop in an aqueous detergent solution containing 20 grams per liter (gm/l) of Alconox (marketed by Alconox, Inc., New York, N.Y.) and deionized water at a temperature of 80° C. The envelope 14 is then rinsed in deionized water at a temperature of about 23° C.

The interior surface of the envelope 14 is then sensitized using an aqueous solution containing 70 gm/l of stannous chloride, 34 milliliters per liter (ml/l) of hydrochloric acid (HCl) and 4 drops per liter of Tergitol (marketed by Union Carbide Corp., Danbury, Conn.) and deionized water. The resultant solution is ultrasonically agitated for about one minute. The envelope 14 is rinsed in deionized water and is then activated in an ultrasonically agitated aqueous palladium chloride solution, consisting essentially of 1 gm/l of palladium chloride, 1 ml/l of HCl and 4 drop/liter of Tergitol, for about one minute. The envelope 14 is rinsed in deionized water and the interior surface is coated with electroless nickel.

The electroless nickel coating consists essentially of 40 ml/l of concentrated nickel sulfamate (available from M. and T. Chemicals, Rahway, N.J.), 20 gm/l of sodium hypophosphite (available from Fisher Scientific, King of Prussia, Pa.), 3 drops of Terigtol per liter and 1 ml/l of a chelating agent such as Hamp-Ol (marketed by Hampshire Chemical Co. Nassau, N.Y.). The elctroless nickel solution is maintained at 65° C. and the interior surface of the envelope 14 is immersed in the solution for about 8 minutes to provide a substantially uniform first conductive layer 52. The envelope 14 is drained of the solution, rinsed in deionized water and air dried. The resistance of the electroless nickel coating or layer 52, measured from end-to-end of the envelope 14, should be not greater than 100 ohms. This value of resistance indicates a nickel layer 52 having a thickness in the range of about 500 to 1000 Å.

The envelope 14 containing the first conductive layer 52 is then air baked at a temperature of about 200° C. for about 16 hours to fully dry the envelope and the nickel coating. When the envelope 14 has cooled to room temperature, an adherent very thin film of electrolytic gold is applied over the nickel layer 52. The very thin gold film consists essentially of Aurobond TN (available from Sel-Rex, Nutley, N.J.). The envelope 14 having the very thin film of gold applied to the nickel layer 52 is then rinsed in deionized water and electrolytically plated in a plating solution consisting essentially of 1 gallon (3.79 liters) of BDT 510 (marketed by Sel Rex, Nutley, N.J.) for about two minutes to build-up the previously applied thin gold film and form a substantially uniform second conductive layer 54 of gold overlying the first conductive layer 52 of nickel. The envelope 14 is, once again, rinsed in deionized water and air dried.

The interior surface of the envelope 14 is coated with a positive photoresist such as HPR204 (not shown) as is known in the art. HPR204 is manufactured by Hunt Chemical, West Paterson, N.J. The resist-coated envelope 14 is placed on a roller-dryer and roll-dried at about 80° C. for about 2 minutes. The envelope 14 is then oven dried in a circulating air oven at about 95° C. for about 30 minutes. The envelope 14 is cooled to room temperature and an exposure mask (not shown) that defines the deflection yoke is inserted therein. Actinic radiation is used to expose portions of the photoresist film. A suitable aqueous photoresist developer, such as Waycoat Positive LSI developer, available from Hunt Chemical, is used to remove the soluble exposed portions of the positive photoresist. The envelope containing hardened insoluble areas of photoresist and exposed areas of the second conductive layer 54 is rinsed in deionized water and air dried.

The exposed portions of the second conductive layer 54 are stripped without damaging the hardened photoresist. If the second conductive layer 54 comprises gold, then an aqueous cyanide solution consisting essentially of 60 gm/l Technistrip AU (available from Technic Inc., Providence, R.I.) is used to remove the exposed portions of the gold layer and to expose underlying portions of the first conductive layer 52. The envelope is rinsed in deionized water to remove all traces of the stripping solution and is air dried. The exposed portions of the first conductive layer 52 are stripped in a suitable acid solution to electrically isolate the four patterns which comprise the electrostatic yoke 46. If the first conductive layer 52 comprises nickel, then No. 233 Nickel Strip (available from Fidelity Products, Newark, N.J.) is used. Alternatively, a one component stripper such as aquaregia, may be used to sequentially remove both the second and first layers 54 and 52, respectively, in one processing step. After the stripping operation is completed, the envelope is once again rinsed in deionized water and dried. The hardened photoresist is removed from the interior surface of the envelope by immersing the envelope in acetone and then rinsing the envelope in fresh acetone. The envelope 14 is dried, inspected for holes or scratches in the electrostatic yoke 46 and electrically tested. Each of the four patterns of the yoke 46 must be electrically isolated from the other, and the electrical resistance of each pattern, measured from the respective terminals 48 to the opposite end of the pattern should be about 100 ohms or less. The envelope 14 is then vacuum fired at a temperature of about 450° for 1 hour.

What is claimed is:

1. In an imaging system for focusing and deflecting an electron beam comprising:

an evacuated envelope structure having a longitudinal axis; magnetic field means for generating a substantially uniform magnetic field within the envelope and along said axis thereof;

an electrostatic yoke within said envelope for generating a variable substantially uniform electric field within said envelope to deflect said electon beam along two coordinates of said system, said electric field being orthogonal to said magnetic field;

an electron gun disposed within said envelope for generating and directing said electron beam through said magnetic and electric fields; and a target located within said envelope opposite said electron gun, said target being disposed in a plane perpendicular to said longitudinal axis, the improvement wherein said electrostatic yoke comprising a first conductive layer bonded to said interior surface of said envelope and a second conductive layer overlying said first conductive layer and being in contact therewith, said first layer having a thickness in the range of about 500 to 1000 Å and said second layer having a thickness in the range of about 800 to 1500 Å, said first and second layers including two pairs of interleaved electrodes.

2. In an electron tube of the type comprising:

an evacuated envelope having oppositely disposed ends and a longitudinal axis;

a faceplate closing one end of said envelope;

a target adjacent to said faceplate and disposed in a plane perpendicular to said longitudinal axis;

an electron gun disposed within said envelope for generating and directing an electron beam; and an electrostatic yoke within said envelope for generating a variable substantially uniform electric field within said envelope to deflect said electron beam along two coordinates, the improvement wherein said electrostatic yoke comprising a first conductive layer bonded to an interior surface of said envelope and a second conductive layer overlying said first layer and being in contact therewith, said first layer having a thickness within the range of about 500 to 1000 Å and said second layer having a thickness within the range of about 800 to 1500 Å, said first and second layer including two pairs of interleaved electrodes.

3. The tube as described in claim 2 wherein said first conductive layer is a metal selected from the group consisting of nickel and copper.

4. The tube as described in claim 2 wherein said second conductive layer is a metal selected from the group consisting of gold and silver.

5. A method for forming an electrostatic yoke on an interior surface of a glass envelope comprising (a) providing a substantially uniform first layer of a first conductive material which is bonded to said interior surface, (b) providing a substantially uniform second layer of a second conductive material over said first layer, (c) forming a photoresist film on said second layer (d) exposing to light portions of said photoresist film, (e) removing said exposed portions of said photoresist film by means of an aqueous solution of a photoresist developer to expose portions of said second layer, and (f) removing said exposed portions of said second layer and said underlying first layer.

6. The method as described in claim 5 wherein the following steps preceed step (a):

(i) cleaning said envelope in an aqueous detergent solution, (ii) sensitizing said interior surface of said envelope with a stannous chloride solution, and (iii) activating said envelope with a palladium chloride solution.

7. The method as described in claim 5 wherein step (a) includes the substeps of (i) uniformly coating said interior surface of said envelope with electroless nickel to a thickness in the range of about 500 to 1000 Å, (ii) rinsing said envelope in deionized water, and (iii) baking said envelope at a temperature of about 200° C.

8. The method as described in claim 5 wherein step (b) includes the substeps of (i) providing an adherent, very thin film of gold over said first layer, (ii) rinsing said envelope in deionized water, (iii) plating said thin film of gold with an electrolytic gold plate to a total thickness within the range of about 800 to 1500 Å.

9. The method as described in claim 5 wherein step (f) includes the substeps of (i) stripping said exposed portions of said second layer in a cyanide solution, (ii) rinsing said envelope in deionized water, (iii) stripping said exposed portions of said first layer in an acid solution, and (iv) rinsing said envelope in deionized water.

10. The method as described in claim 5 wherein step (f) includes the substeps of (i) stripping said exposed portions of said second layer in a suitable solution to remove said second layer and the underlying first layer, and (ii) rinsing said envelope in deionized water.

11. The method as described in claim 5 wherein subsequent to step (f) the following steps are preformed (i) removing said photoresist from said interior surface of said envelope by immersing the same in acetone, (ii) rinsing said envelope in clean acetone, and (iii) vacuum baking said envelope at about 450° C. for about 1 hour.

* * * * *